US008847125B2

(12) United States Patent
Tseng et al.

(10) Patent No.: US 8,847,125 B2
(45) Date of Patent: Sep. 30, 2014

(54) LOCAL RESISTANCE HEATING DEVICE WITH A CONTROLLED ATMOSPHERE

(75) Inventors: Kuang-Hung Tseng, Kaohsiung (TW); Jie-Meng Huang, Neipu Hsiang (TW)

(73) Assignee: National Pingtung University of Science & Technology, Pingtung County (TW)

( * ) Notice: Subject to any disclaimer, the term of this patent is extended or adjusted under 35 U.S.C. 154(b) by 777 days.

(21) Appl. No.: 13/095,991

(22) Filed: Apr. 28, 2011

(65) Prior Publication Data

US 2012/0223068 A1 Sep. 6, 2012

(30) Foreign Application Priority Data

Mar. 3, 2011 (TW) ..... 100107154 A

(51) Int. Cl.
*H05B 3/02* (2006.01)
*F27D 1/00* (2006.01)

(52) U.S. Cl.
CPC ..... *H05B 3/023* (2013.01)
USPC ..... 219/538; 432/247; 204/298.12

(58) Field of Classification Search
USPC ..... 219/538, 443.1; 432/247, 253, 242, 432/259; 204/298.12, 298.14
See application file for complete search history.

(56) References Cited

U.S. PATENT DOCUMENTS

| | | | |
|---|---|---|---|
| 7,871,265 | B2 | 1/2011 | Fukuoka et al. |
| 7,878,386 | B2 | 2/2011 | Weber |
| 7,891,975 | B2 | 2/2011 | Sasajima et al. |
| 7,927,096 | B2 | 4/2011 | Fukumoto et al. |
| 7,951,276 | B2 * | 5/2011 | Donchev et al. ..... 204/298.12 |

* cited by examiner

*Primary Examiner* — Shawntina Fuqua
(74) *Attorney, Agent, or Firm* — Alan Kamrath; Kamrath IP Lawfirm, P.A.

(57) ABSTRACT

A local resistance heating device, with a controlled atmosphere, includes two end members and a mid member. The two end members are respectively connected with an anode pole and a cathode pole. Each end member has an air channel. The air channel of one of the end members is adapted to connect with an output terminal of a gas supplier, and the air channel of the other one of the end members is adapted to connect with a sucking terminal of the gas supplier. The mid member is arranged between the two end members. The two end members and the mid member jointly define a heating room communicating with the air channels of the two end members.

6 Claims, 5 Drawing Sheets

LOCAL RESISTANCE HEATING DEVICE WITH A CONTROLLED ATMOSPHERE

BACKGROUND OF THE INVENTION

1. Field of the Invention

The present invention relates to a heat treatment device and, more particularly, to a local resistance heating device with a controlled atmosphere able to provide only a part of a workpiece with an inert gas to process a resistance heating treatment.

2. Description of the Related Art

Conventionally, in accordance with the heat source, heat treatments can be roughly divided into two kinds: a burning heating method and an electric heating method. The electric heating method further includes a resistance heating treatment, a conduction heating treatment, an electrical heating treatment, and a laser heating treatment.

Moreover, the resistance heating treatment can further be categorized into a direct heating way and an indirect heating way. The direct heating way conducts electricity directly to a workpiece to heat the workpiece via the heat induced by the resistance of the workpiece itself. The indirect heating way puts a workpiece into a heating furnace and controls the temperature of a gas received in the heating furnace by the heated pieces arranged inside the heating furnace, to heat the workpiece by the heated gas. Specifically, inert gas such as argon and helium can be taken as the gas received in the heating furnace for avoiding oxidation of the workpiece during processes of the heat treatment.

However, in the condition that only a part of the workpiece has to be heated or the volume of the workpiece is small, an inner space of the heating furnace still has to be filled with the inert gas to activate the anti-oxidation function, and this will lead to a large consumption of the inert gas and thus a great cost. Besides, the size of the workpiece is limited by the inner space of the heating furnace for the heating furnace to completely receive the workpiece and to proceed with the heat treatment. Furthermore, an even thermal environment provided by the heating furnace is hard to achieve, since the heat is generated by the plural heated pieces, and thus results of the heat treatment are usually not good enough. In light of this, it is desired to improve the conventional resistance heating device.

SUMMARY OF THE INVENTION

It is therefore the primary objective of this invention to provide a local resistance heating device with a controlled atmosphere, which can provide the inert gas to a treated portion of a workpiece only, to largely decrease the consumption of the inert gas.

Another objective of this invention is to provide a local resistance heating device with a controlled atmosphere, which can merely proceed with heat treatment to the treated portion of the workpiece without limitation in the size of the workpiece.

Still another objective of this invention is to provide a local resistance heating device with a controlled atmosphere, which can provide an even thermal environment for enhancing the quality of the treated portion.

The invention discloses a local resistance heating device with a controlled atmosphere. The local resistance heating device comprises two end members and a mid member. The two end members are respectively connected with an anode pole and a cathode pole. Each end member has an air channel. The air channel of one of the end members is adapted to connect with an output terminal of a gas supplier, and the air channel of the other one of the end members is adapted to connect with a sucking terminal of the gas supplier. The mid member is arranged between the two end members. The two end members and the mid member jointly define a heating room communicating with the air channels of the two end members.

The invention further discloses that the air channel of each end member has an inner passageway and an outer passageway. The inner passageway has a connecting hole adapted to connect with the gas supplier, the outer passageway has a plurality of nozzles communicating with the heating room, and a connecting channel links the inner and outer passageways.

The invention further discloses that the connecting channel and connecting hole are formed on two opposite sides of an axial center of the end member.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
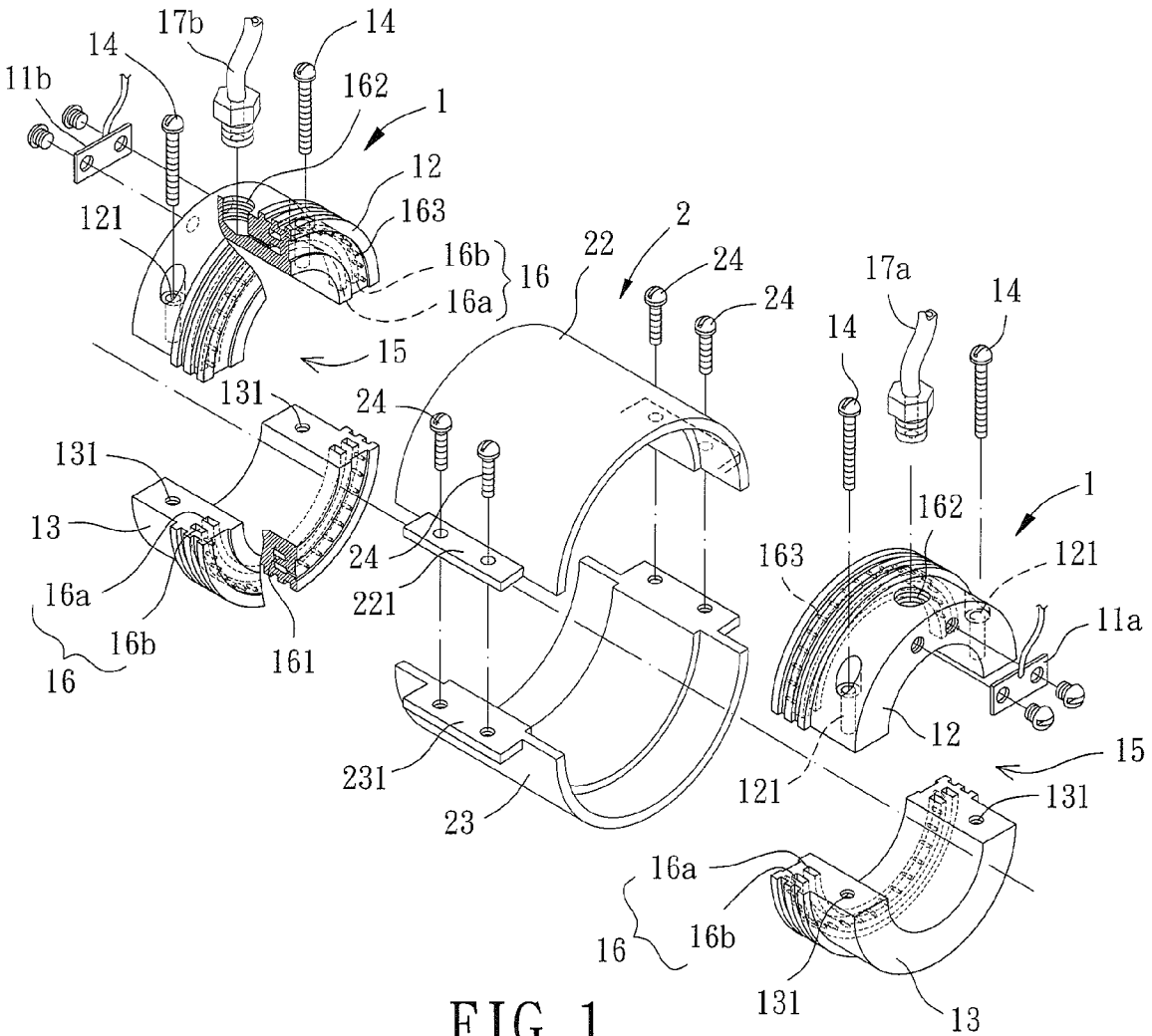
FIG. 1 shows an exploded perspective view of a local resistance heating device with a controlled atmosphere according to a preferable embodiment of the invention.

In the various figures of the drawings, the same numerals designate the same or similar parts. Furthermore, when the terms "first", "second", "inner", "outer" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Referring to FIG. 1, a perspective view of an embodiment of a local resistance heating device of the present invention is shown. The local resistance heating device includes two end members 1 and a mid member 2 between the two end members 1.

The two end members 1 are respectively connected with an anode pole 11*a* and a cathode pole 11*b*. The two end members 1 are oppositely arranged on two sides of the mid member 2, and each end member 1 is in the shape of a ring formed by an integral piece or assembled pieces. In this embodiment, each end member 1 includes a first half-ring 12 and a second half-ring 13 for users to efficiently assemble or dismantle the end members 1. The first half-ring 12 has an assembling hole 121, and the second half-ring 13 has an assembling hole 131 aligning with the assembling hole 121 when the first half-ring 12 engages with the second half-ring 13. Thus, a coupling member 14 can extend through the assembling holes 121, 131 to firmly couple the first and second half-rings 12, 13 together. Accordingly, by the assembled first and second half-rings 12, 13, each end member 1 has a coupling hole 15 formed at an axial center thereof. For each end member 1, an annular air channel 16 is formed inside the end member 1 and extends to an outer surface of the end member 1. Besides, the air channel 16 of one of the end member 1 communicates with an output terminal 17*a* of a conventional gas supplier, and the air channel 16 of the other end member 1 communicates with a sucking terminal 17*b* of the conventional gas supplier.

Specifically, in this embodiment, the air channel 16 includes an inner passageway 16*a* and an outer passageway 16*b*. The inner passageway 16*a* and outer passageway 16*b* coaxially extend around the axial center of the end member 1, with the inner passageway 16*a* being closer to the axial center relative to the outer passageway 16*b*. A connecting channel 161 links the inner and outer passageways 16*a*, 16*b*. In this embodiment, since the end member 1 includes the assembled first and second half-rings 12, 13, the inner and outer passageways 16*a*, 16*b* of the air channel 16 are formed in each of the first and second half-rings 12, 13. Particularly, each of the inner passageways 16*a* has a connecting hole 162 used to connect with the output terminal 17*a* or sucking terminal 17*b* of the conventional gas supplier, and each of the outer passageways 16*b* has a plurality of nozzles 163 extending to and connecting with the outer surface of the end member 1 facing the other end member 1. Moreover, in order to provide the whole air channel 16 with an evenly arranged air pressure, the connecting channel 161 and connecting hole 162 are preferably formed on two opposite sides of the axial center of the end member 1. Therefore, injected gas will not enter the outer passageway 16*b* until the inner passageway 16*a* is filled with the injected gas.

Figure 2:
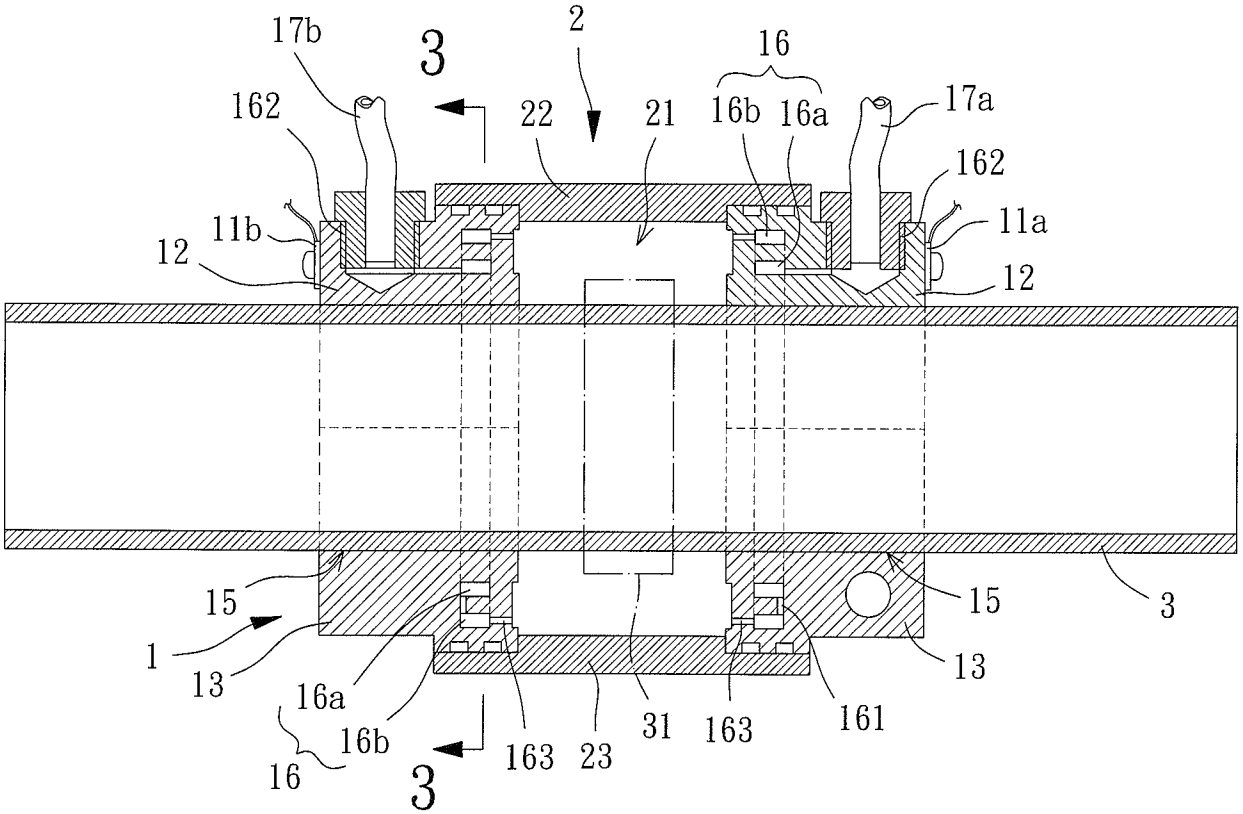
FIG. 2 shows a cross-sectional view of the local resistance heating device with a controlled atmosphere according to the preferable embodiment of the invention.

The mid member 2 is arranged between the two end members 1. The mid member 2 and end members 1 jointly define a heating room 21 as shown in FIG. 2, with the heating room 21 communicating with the two air channels 16 of the end members 1. In this embodiment, the heating room 21 communicates with the outer passageway 16*b* through the nozzles 163. Preferably, the mid member 2 includes a first bent plate 22 and a second bent plate 23. The first bent plate 22 is coupled with the first half-rings 12 of the two end members 1, and the second bent plate 23 is coupled with the second half-rings 13 thereof. Furthermore, the first bent plate 22 has at least one assembling portion 221, and the second bent plate 23 has at least one assembling portion 231 aligning with the first assembling portion 221 for coupling with the first assembling portion 221 when the first bent plate 22 engages with the second bent plate 23. Thus, at least one coupling member 24 can firmly couple the first and second bent plates 22, 23 together.

Figure 3:
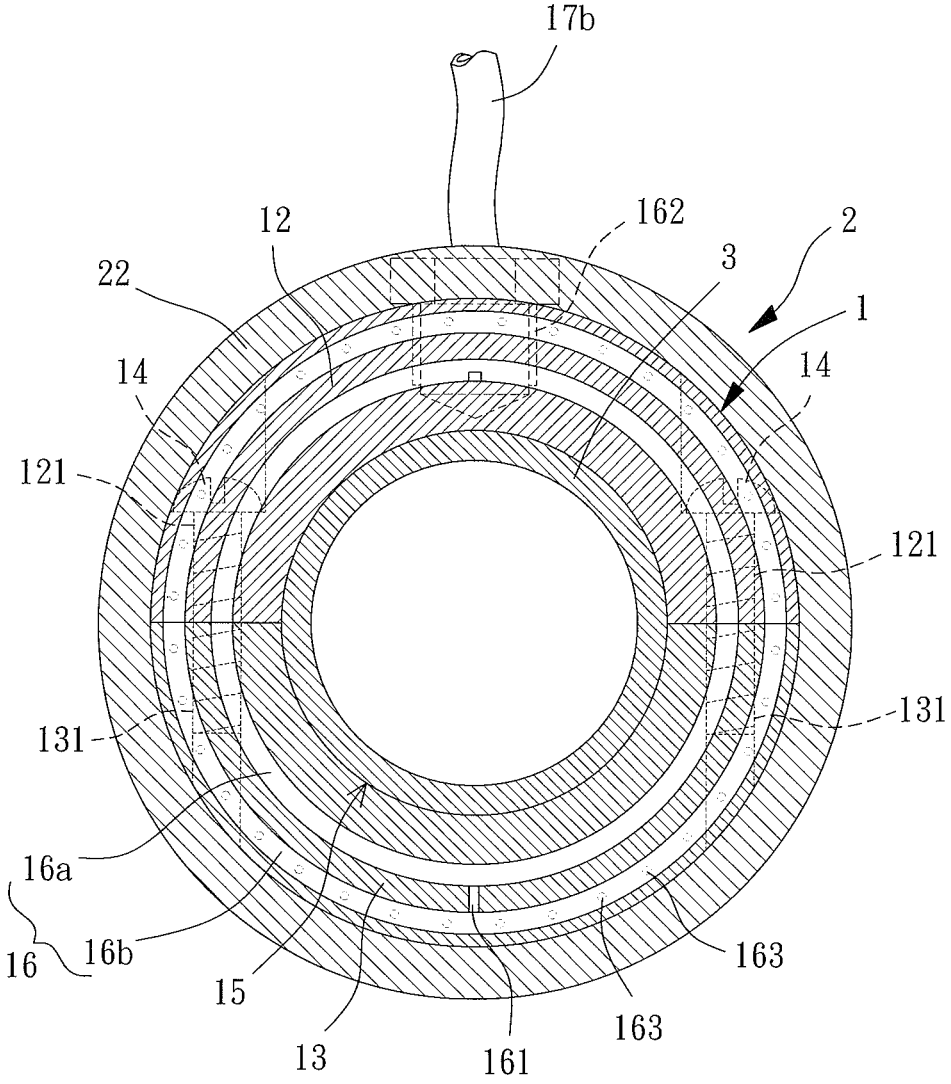
FIG. 3 shows a cross-sectional view of the local resistance heating device with a controlled atmosphere according to the preferable embodiment of the invention along the line 3-3 in FIG. 2.

Referring to FIGS. 2 and 3, a treated portion 31 of a workpiece 3 is disposed in the heating room 21, and the two end members 1 abut against the outer surfaces of the workpiece 3 when the present invention is used to heat the treated portion 31. Accordingly, inert gas, such as argon and helium provided by the gas supplier for proceeding with the heat treatment, is injected into the air channel 16 of the end member 1 connecting with the output terminal 17*a* and then guided to the heating room 21 to enclose the treated portion 31 of the workpiece 3. In this situation, the anode pole 11*a* and cathode pole 11*b* are energized to raise the temperature of the two end members 1, as well as the temperature of the treated portion 31, to proceed with the heat treatment. Besides, when the temperature of the inert gas enclosing the treated portion 31 is too high, the heated gas can be exhausted by the sucking terminal 17*b* of the conventional gas supplier through the air channel 16 of the end member 1 connecting with the sucking terminal 17*b*. With the above-illustrated structure, only a small amount of inert gas for enclosing the treated portion 31 is used, since only the treated portion 31, instead of the whole workpiece 3, is enclosed by the inert gas.

In this embodiment, walls defining the coupling hole 15 formed at the axial center of each end member 1 by the assembled first and second half-rings 12, 13 closely abut against the outer surfaces of the workpiece 3 to firmly dispose the treated portion 31 in the heating room 21, while the first bent plate 22 and second bent plate 23 respectively couple with outer peripheries of first and second half-rings 12, 13 of the two end members 1 to form the heating room 21.

Furthermore, in this embodiment, the inert gas provided by the gas supplier can be guided into the inner passageway 16*a* through the connecting hole 162 connecting with the output terminal 17*a*, and enters the outer passageway 16*b* through the connecting channel 161 after the inner passageway 16*a* is filled with the inert gas, since the connecting channel 161 and connecting hole 162 are formed on two opposite sides of the axial center of the end member 1. Finally, the inert gas enters the heating room 21 through the nozzles 163 to evenly spread inside the heating room 21 and enclose the treated portion 31. On the other hand, by the sucking terminal 17*b*, the other air channel 16 can guide and exhaust the heated gas via the nozzles 163, outer passageway 16*b*, connecting channel 161, and inner passageway 16*a* thereof sequentially. As a result, with the increased route from the output terminal 17*a* or sucking terminal 17*b* to the heating room 21 provided by the inner passageway 16*a*, connecting channel 161, outer passageway 16*b*, and nozzles 163, the inert gas newly ejected by the output terminal 17*a* with high pressure is forbidden from directly entering the heating room 21, and the inert gas may not be strongly sucked by the sucking terminal 17*b* directly, either. Namely, the pressure of the inert gas entering or exiting the heating room 21 is low enough to maintain an even thermal environment around the treated portion 31, so that the treated portion 31 of the workpiece 3 can be evenly heated, and, thus, the structural strength of the workpiece 3 is good.

Specifically, the air channel 16 can be in another arrangement able to increase the route from the output terminal 17*a* or sucking terminal 17*b* to the heating room 21. For example, instead of the inner passageway 16*a* of the end member 1, the outer passageway 16*b* forms the connecting hole 162 to connect with the output terminal 17*a* or sucking terminal 17*b*, while the nozzles 163 are alternatively formed at the inner passageway 16*a*.

Figure 4:
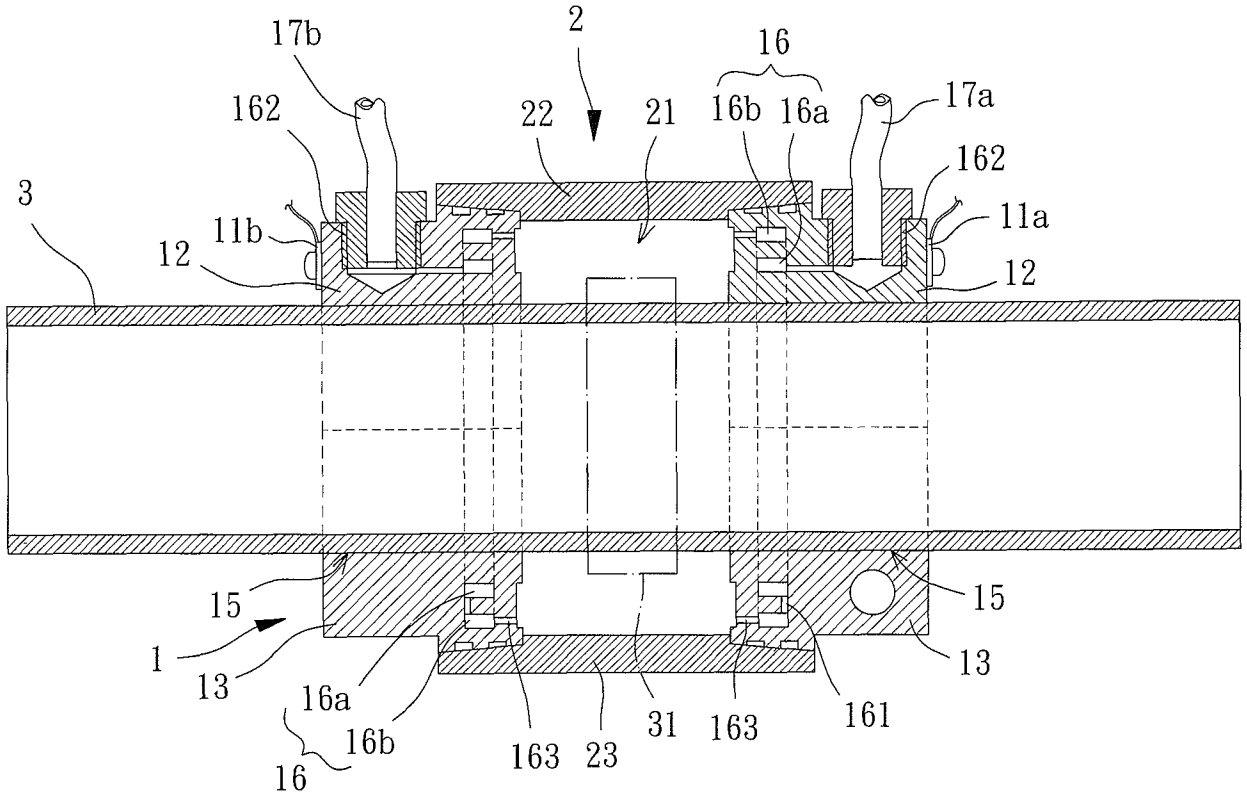
FIG. 4 shows a cross-sectional view of the local resistance heating device with a controlled atmosphere according to another example of the preferable embodiment of the invention.

Referring to FIG. 4, an outer surface of the end member 1 facing and abutting against the mid member 2 can be in a tip-cut cone shape, while each of the outer surfaces of the mid member 2 abutting against the end members 1 is in a shape corresponding to the tip-cut cone shape. Therefore, an enhanced engagement between the end members 1 and mid member 2 is provided to further prevent a leak of the inert gas from the heating room 21.

Figure 5:
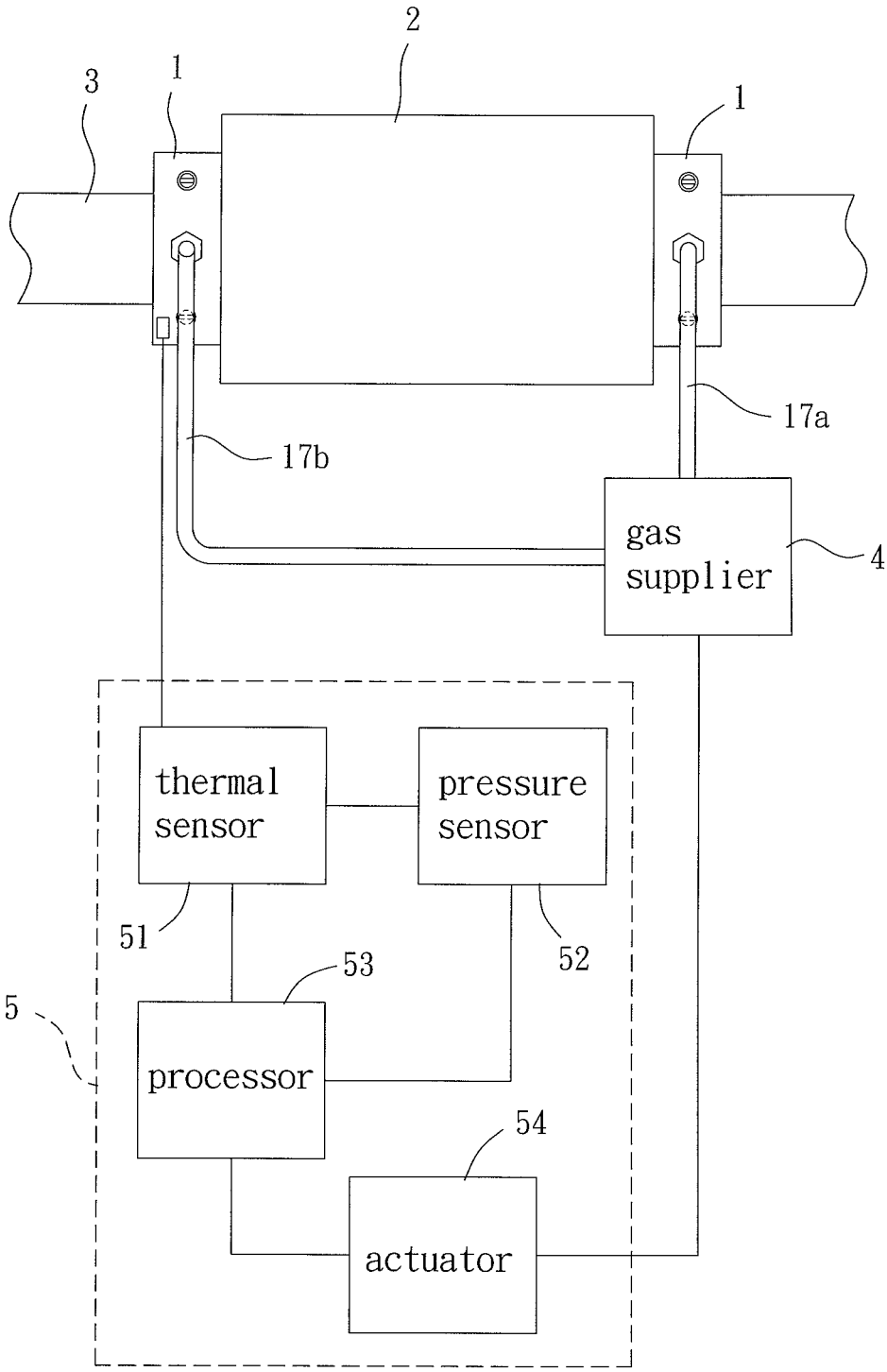
FIG. 5 shows a block diagram of the local resistance heating device with a controlled atmosphere according to the preferable embodiment of the invention having a controller.

Referring to FIG. 5, a controller 5 having a thermal sensor 51, a pressure sensor 52, a processor 53 and an actuator 54 can be further provided, which is preferably arranged at the sucking terminal 17*b* of the gas supplier 4. The sensors 51, 52 are electrically connected with the processor 53, and the processor 53 is electrically connected with the actuator 54. Accordingly, the thermal sensor 51 and pressure sensor 52 can detect the temperature and pressure of the inert gas in the heating room 21 in a real-time way, and transmit sensed signals to the processor 53. Thus, the processor 53 can control the actuator 54 to drive the gas supplier 4. In operation, when the processor 53 identifies that the temperature of the sensed signal of the thermal sensor 51 is too high, the processor 53 controls the actuator 54 to drive the gas supplier 4 speeding up in air output and sucking, to lower the temperature of the inert gas in the heating room 21. Contrarily, the speed of air output and sucking of the gas supplier 4 will be lowered when the temperature corresponding to the sensed signal of the thermal sensor 51 is low enough, to decrease the consumption of the inert gas.

As a result, the local resistance heating device with a controlled atmosphere of the present invention can automatically maintain the inert gas in the heating room 21 at a preferable temperature and pressure, to provide a suitable environment for heat treatment of weld metal. Thus, the structural strength of the weld metal can be enhanced. Besides, since the situation of the heating room 21 can be automatically adjusted, other kinds of heat treatment such as annealing, hardening, and tempering are also implementable.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A local resistance heating device with a controlled atmosphere, comprising:

two end members respectively connected with an anode pole and a cathode pole, with each end member having an air channel, with the air channel of one of the two end members adapted to connect with an output terminal of a gas supplier, with the air channel of another one of the two end members adapted to connect with a sucking terminal of the gas supplier; and a mid member arranged between the two end members, wherein the two end members and the mid member jointly define a heating room communicating with the air channels of the two end members, wherein the air channel of each end member has an inner passageway and an outer passageway, wherein the inner passageway has a connecting hole adapted to connect with the gas supplier, wherein the outer passageway has a plurality of nozzles communicating with the heating room, and wherein a connecting channel links the inner and outer passageways.

2. The local resistance heating device with a controlled atmosphere as claimed in claim 1, wherein the connecting channel and the connecting hole are formed on two opposite sides of an axial center of each end member.

3. A local resistance heating device with a controlled atmosphere, comprising:

two end members respectively connected with an anode pole and a cathode pole, with each end member having an air channel, with the air channel of one of the two end members adapted to connect with an output terminal of a gas supplier, with the air channel of another one of the two end members adapted to connect with a sucking terminal of the gas supplier; and a mid member arranged between the two end members, wherein the two end members and the mid member jointly define a heating room communicating with the air channels of the two end members, wherein each end member includes a first half-ring and a second half-ring, and wherein the first half-ring engages with the second half-ring.

4. The local resistance heating device with a controlled atmosphere as claimed in claim 3, wherein the first half-ring has an assembling hole, the second half-ring has another assembling hole aligning with the assembling hole of the first half-ring, and a coupling member extends through the assembling holes to firmly couple the first and second half-rings together.

5. A local resistance heating device with a controlled atmosphere, comprising:

two end members respectively connected with an anode pole and a cathode pole, with each end member having an air channel, with the air channel of one of the two end members adapted to connect with an output terminal of a gas supplier, with the air channel of another one of the two end members adapted to connect with a sucking terminal of the gas supplier; and a mid member arranged between the two end members, wherein the two end members and the mid member jointly define a heating room communicating with the air channels of the two end members, and wherein an outer surface of each end member facing and abutting against the mid member is in a tip-cut cone shape.

6. A local resistance heating device with a controlled atmosphere, comprising:

two end members respectively connected with an anode pole and a cathode pole, with each end member having an air channel, with the air channel of one of the two end members adapted to connect with an output terminal of a gas supplier, with the air channel of another one of the two end members adapted to connect with a sucking terminal of the gas supplier;

a mid member arranged between the two end members, wherein the two end members and the mid member jointly define a heating room communicating with the air channels of the two end members; and a controller having a thermal sensor, a pressure sensor, a processor and an actuator, wherein the thermal sensor and the pressure sensor are electrically connected with the processor, wherein the processor is electrically connected with the actuator, and wherein the actuator is adapted to control the gas supplier.

* * * * *